US009999306B1

(12) United States Patent
Powell, III

(10) Patent No.: US 9,999,306 B1
(45) Date of Patent: Jun. 19, 2018

(54) CONVERTIBLE STAND FOR CONCEALING A MATTRESS

(71) Applicant: Robert J Powell, III, Riverview, FL (US)

(72) Inventor: Robert J Powell, III, Riverview, FL (US)

( * ) Notice: Subject to any disclaimer, the term of this patent is extended or adjusted under 35 U.S.C. 154(b) by 11 days.

(21) Appl. No.: 15/382,270

(22) Filed: Dec. 16, 2016

(51) Int. Cl.
*A47C 17/22* (2006.01)
*A47C 17/52* (2006.01)
*A47C 27/08* (2006.01)

(52) U.S. Cl.
CPC ..... *A47C 17/52* (2013.01); *A47C 27/081* (2013.01)

(58) Field of Classification Search
CPC ..... A47C 17/52; A47C 17/38; A47C 17/48; A47C 17/50; A47C 17/54; A47C 17/56; A47C 17/58; A47C 17/60
See application file for complete search history.

(56) References Cited

U.S. PATENT DOCUMENTS 271,485 A * 1/1883 Lude ..... A47C 17/60 5/12.1
1,718,880 A * 6/1929 Ross ..... A47K 11/04 297/154
1,731,325 A * 10/1929 Stevens ..... A47B 46/00 190/4
3,330,612 A * 7/1967 Masterson ..... E06B 3/385 217/60 R
3,785,452 A * 1/1974 Scott ..... G06K 1/02 181/201
4,153,958 A * 5/1979 Paulik ..... A47C 4/52 297/118
4,167,298 A * 9/1979 Plattner ..... E05F 1/1075 217/60 R
4,169,295 A * 10/1979 Darling ..... A47C 4/54 5/706
5,913,769 A * 6/1999 Byma ..... A47B 85/00 5/2.1
6,471,312 B1 * 10/2002 Coffey ..... E05F 5/10 312/319.2
6,779,856 B2 * 8/2004 Hornberger ..... E05F 17/004 312/295
6,951,039 B2 * 10/2005 Roseff ..... A47C 27/082 5/654
7,246,393 B2 * 7/2007 Westendorf ..... A47C 27/081 5/12.1

(Continued)

*Primary Examiner* — Robert G Santos
*Assistant Examiner* — Ifeolu Adeboyejo
(74) *Attorney, Agent, or Firm* — Inventions International Inc.; Tiffany C. Miller

(57) ABSTRACT

A convertible stand for concealing an inflatable mattress that converts into a headboard when the inflatable mattress is inflated. The convertible stand has a compartment. A pliable material is connected to the inflatable mattress. A portion of the pliable material extends beyond an end of the inflatable mattress and is connected to an inner wall surface of the compartment. A barrier is connected to the convertible stand. When the barrier is oriented in an upper position the compartment is open and the inflatable mattress can be inflated. When the barrier is oriented in a lower position the compartment is closed and both the deflated inflatable mattress and pliable material are retained within the compartment of the convertible stand.

4 Claims, 5 Drawing Sheets

(56) References Cited

U.S. PATENT DOCUMENTS

| | | | | |
|---|---|---|---|---|
| 7,401,370 | B2 * | 7/2008 | McClintock | A47C 17/82 5/654 |
| 7,555,797 | B1 * | 7/2009 | Wu | A47C 27/081 5/12.1 |
| 8,176,588 | B2 * | 5/2012 | Lin | A47C 4/54 190/2 |
| 8,439,174 | B1 * | 5/2013 | Miranda | A45C 5/14 190/1 |
| 8,503,182 | B2 * | 8/2013 | Petrick | G06F 1/1626 312/223.1 |
| 2002/0166168 | A1 * | 11/2002 | Weedling | A61G 7/103 5/81.1 R |
| 2007/0199153 | A1 * | 8/2007 | Wu | A47C 27/081 5/706 |
| 2010/0123347 | A1 * | 5/2010 | Lin | A47C 27/082 297/452.41 |
| 2011/0056788 | A1 * | 3/2011 | Jackson | A45B 23/00 190/2 |
| 2011/0088986 | A1 * | 4/2011 | Chen | A45C 5/14 190/2 |
| 2014/0310879 | A1 * | 10/2014 | Rox | A47C 17/04 5/706 |
| 2016/0278533 | A1 * | 9/2016 | Rox | A47C 17/13 |

* cited by examiner

CONVERTIBLE STAND FOR CONCEALING A MATTRESS

BACKGROUND OF THE INVENTION

1. Field of the Invention

This invention relates, generally, to a convertible stand for concealing an inflatable mattress. More particularly, it relates to a furniture stand having a compartment retaining a pliable material and an inflatable mattress when the air mattress is deflated. The furniture stand converts into a headboard when the air mattress is inflated.

2. Background Art

Many residential homes have a single guest room. A mattress, typically takes up the majority of space in many of these smaller homes. As a result, valuable space within a room is lost to accommodate a furniture bed set and a bulky mattress. Thus, there is a need for a convertible stand that can quickly reveal an inflatable mattress when in use and then to conveniently store and conceal an inflatable mattress when not in use. By eliminating the need for a stationary bed set and mattress, the space within a room can be utilized to its maximum potential with the use of the novel convertible stand.

Mattresses and bed sets in today's market can be costly for many individuals. There is a need for a more affordable, lower cost alternative to purchasing a stationary bed set and mattress. Thus, there is a need for a convertible stand for concealing an inflatable mattress that converts into a headboard when the inflatable mattress is inflated. This convertible stand eliminates the need for a mattress and eliminates the need for a traditional bed set, resulting in a cost effective sleeping solution.

Currently, homes and offices may use wall beds or roll-out beds to conserve space within a room. A wall bed system stores a mattress within a substantially large piece of furniture capable of retaining a large and bulky mattress. When not in use, a roll-out bed needs to be stored away and often takes up closet space or requires a bulky sofa to be stored within. The problem with a wall bed and with a roll-out bed is that they both take up a significant portion of a room's space when not in use during storage. Thus, there is a need for a convertible stand that can provide a compact storage solution for concealing an inflatable mattress. A convertible stand for concealing an inflatable mattress is more desirable because it takes up less space than a wall bed-system or a roll-out bed because the need for a bulky mattress is eliminated.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a convertible stand for concealing an inflatable mattress that converts into a headboard when the inflatable mattress is inflated. The convertible stand has a compartment. A pliable material is connected to the inflatable mattress. A portion of the pliable material extends beyond an end of the inflatable mattress and is connected to an inner wall surface of the compartment. A barrier is connected to the convertible stand. When the barrier is oriented in an upper position, the compartment is open and the inflatable mattress can be inflated. When the barrier is oriented in a lower position, the compartment is closed and both the deflated inflatable mattress and the pliable material are retained within the compartment of the convertible stand which also includes improvements that overcome the limitations of prior art convertible stands is now met by a new, useful, and non-obvious invention.

The novel convertible stand has a compartment. The compartment has a compartment opening. An inflatable mattress is connected to at least a portion of a pliable material. The pliable material has a primary end located opposite a secondary end. The primary end of the pliable material extends beyond an end of the inflatable mattress. A portion of the primary end of the pliable material is connected to an inner wall surface of the compartment. A barrier is connected to the convertible stand. The barrier is configured to be oriented in an upper position and a lower position.

A portion of the inflatable mattress is exposed when the barrier is oriented in an upper position. A portion of the barrier is positioned at a height that is higher than the inflatable mattress when the inflatable mattress is inflated. At least a portion of the inflatable mattress is positioned substantially parallel to the barrier when the inflatable mattress is inflated. The deflated inflatable mattress and the pliable material are both retained within the compartment of the convertible stand when the barrier is oriented in the lower position. In the lower position, the barrier covers at least a portion of the compartment opening of the convertible stand.

In an alternate embodiment, the novel convertible stand has at least one fastener connected to the barrier. The at least one fastener secures the barrier to the convertible stand to retain the barrier in the upper position.

In another embodiment, the novel convertible stand has at least a portion of the inflatable mattress being in communication with an inner wall surface of the compartment of the convertible stand when the inflatable mattress is inflated. At least a portion of the inflatable mattress is located within the compartment and has a height that is smaller in size than the height of the inflatable mattress that is positioned outside of the compartment.

In yet another embodiment, the inflatable mattress can have an air pump connected thereto.

In an alternate embodiment, the convertible stand has a compartment having a compartment opening. At least a portion of an inflatable mattress is in communication with an inner wall surface of the compartment when the inflatable mattress is inflated. It is within the scope of this invention for the inflatable mattress to be connected to an inner wall surface of the compartment or for any material including, but not limited to, a skid resistant material or a pliable material to be connected to any inner wall surface of the compartment and then having a portion of the inflatable mattress overlay the material. At least a portion of the inflatable mattress is located within the compartment and has a height that is shorter in size than the height of the inflatable mattress positioned outside of the compartment.

It is therefore an important object of the present invention to provide a convertible stand for concealing an inflatable mattress when the inflatable mattress is deflated that converts into a headboard when the inflatable mattress is inflated.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
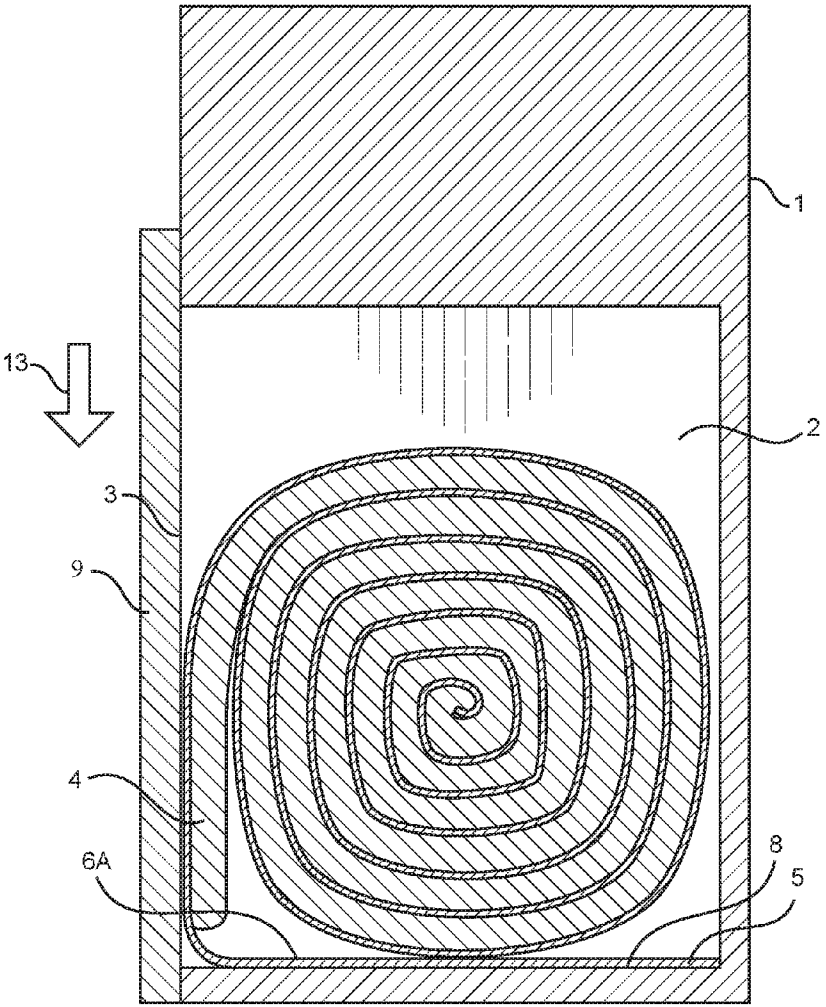
FIG. 1 is a side cut-away view of the novel convertible stand concealing both a deflated inflatable mattress and pliable material within a compartment when the barrier is oriented in a lower position.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment, the novel convertible stand has a compartment. A primary end of a pliable material is in communication with an inner wall surface of the compartment. It is within the scope of this invention for an inner wall surface of the compartment to include, and not be limited to, a side wall, a bottom wall, a rear wall, or a top wall. It is within the scope of the invention for a pliable material to include, and not be limited to, skid resistant material or any material capable of being folded or rolled.

In a preferred embodiment, it is within the scope of the current invention for the novel convertible stand to have at least one shelf and/or cabinet connected thereto. The convertible stand can be connected to including, but not limited to, an office desk, a shelving unit, an entertainment center, or a bed set. The novel convertible stand can be installed into existing storage/cabinetry systems or can be used alone.

In another embodiment, a barrier is connected to the convertible stand. It is within the scope of this invention for the barrier to include, but not be limited to, a plate, a door, or any material that is capable of concealing the compartment opening when oriented in a lower position and functioning as a headboard when oriented in an upper position when the mattress is inflated. It is a preferred embodiment for the barrier to be hingedly connected to the convertible stand. It is also within the scope of the invention for the barrier to slidably traverse a portion of the convertible stand from an open position to a closed position.

In another embodiment, at least one fastener can have a portion of the fastener connected to the barrier and can have another portion of the fastener connected to a portion of the convertible stand. The fastener anchors the barrier in an upper position. It is within the scope of this invention for any locking mechanism to secure the barrier in an upper position.

In a preferred embodiment, when the barrier is oriented in an upper position, the barrier is positioned in a higher location than the inflated mattress. The barrier serves as a headboard when the barrier is positioned in a higher location than the inflated mattress.

In a preferred embodiment, the primary end of the pliable material extends beyond the inflatable mattress at a length great enough to position at least a portion of the inflatable mattress substantially parallel to the barrier when the primary end of the pliable material is connected to an inner wall surface of the compartment.

In an alternate embodiment, a portion of the inflated mattress can be retained within the compartment. The portion of the inflated inflatable mattress located within the compartment has a height shorter in size than the height of the inflated mattress that is positioned outside of the compartment. The inflatable mattress can be in communication with an inner wall surface of the compartment when the inflatable mattress is inflated. The pliable material may or may not be used. The inflatable mattress can overlay a layer of pliable material connected to an inner wall surface of the compartment or the inflatable mattress can be directly connected to an inner wall surface of the compartment with including, but not limited to, a fastener, a clamp, hook and look fasteners, a snap, a button, or adhesive.

In a preferred embodiment, the inflatable mattress can have an air pump connected thereto. It is within the scope of this invention for the inflatable mattress to have a valve capable of receiving compressed gas or air from an external source.

Construction of the Novel Convertible Stand

It will now be seen, referring to FIG. 1, the novel convertible stand 1 includes compartment 2. Compartment 2 has compartment opening 3 and inner wall surfaces 8. When barrier 9 is oriented in lower position 13, barrier 9 covers compartment opening 3. In an alternate embodiment, barrier 9 can cover at least a portion of compartment opening 3. Inflatable mattress 4 is connected to pliable material 5. Inflatable mattress 4 can overlay a portion of a pliable material 5. A portion 6A of pliable material 5 extends beyond an end of air mattress 4. The extended portion 6A of pliable material 5 is connected to any inner wall surface 8 of compartment 2.

Figure 2:
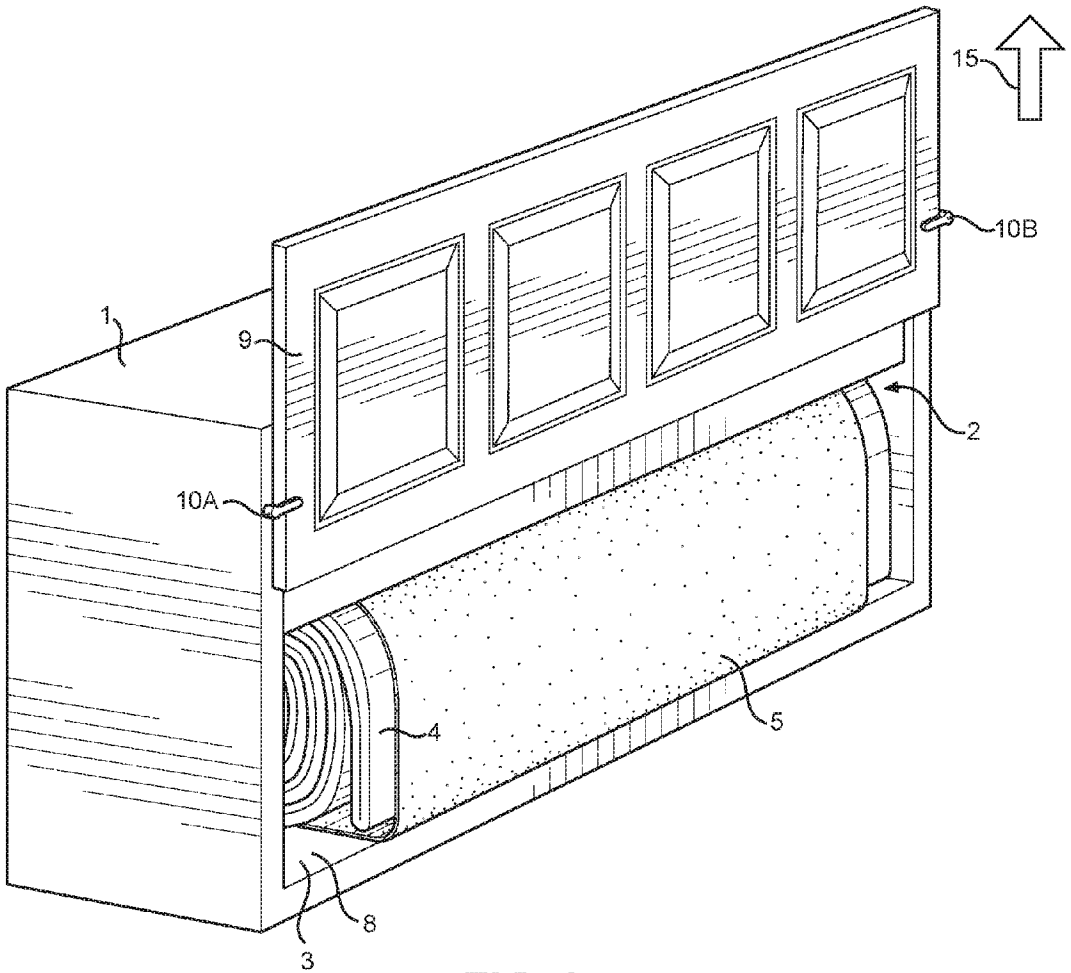
FIG. 2 is a perspective view of the novel convertible stand having the barrier oriented in an upper position to reveal both the pliable material and the inflatable mattress within the compartment.
Figure 3:
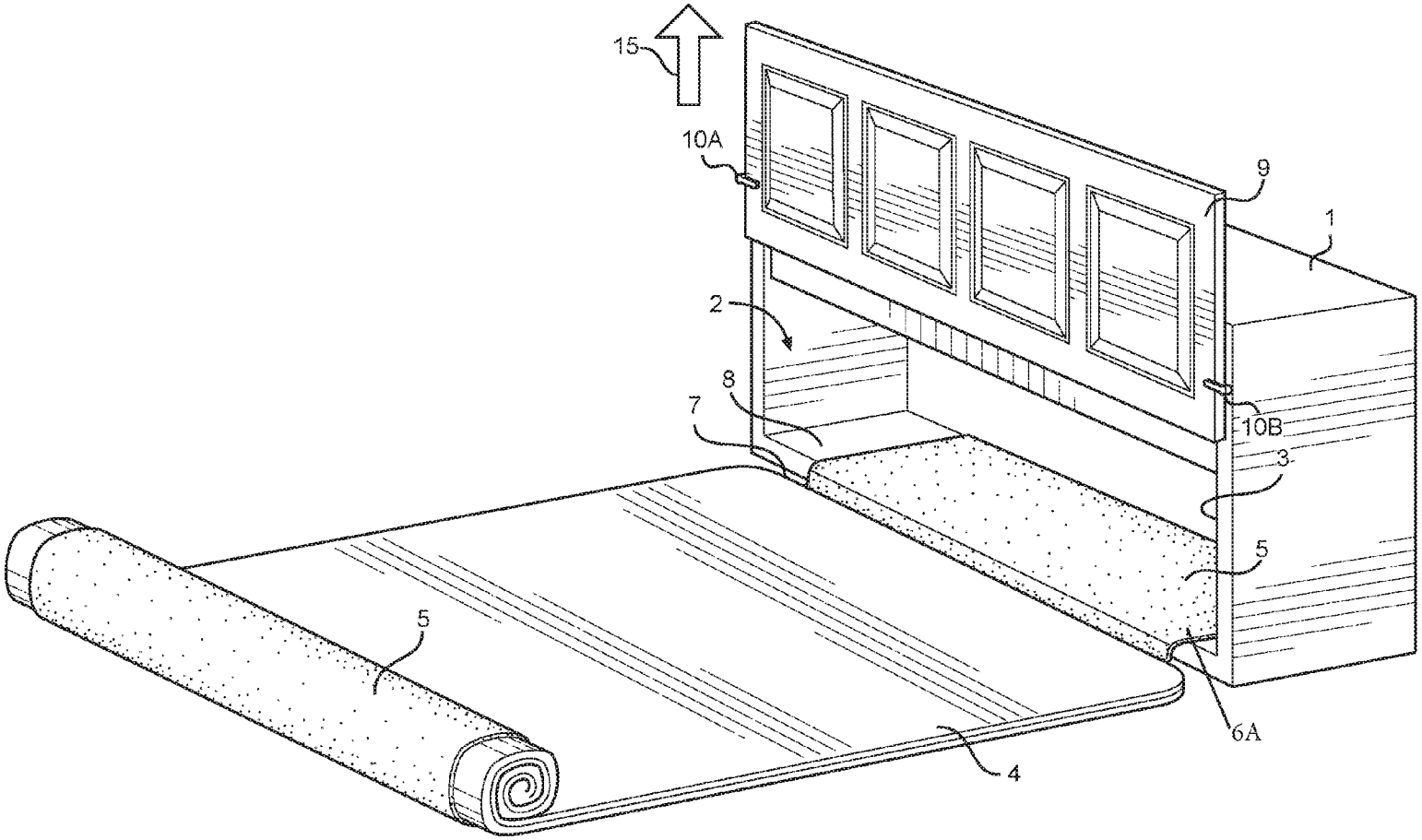
FIG. 3 is a perspective view of the novel convertible stand having the primary end of the pliable material being connected to an inner wall surface of the compartment.
Figure 4A:
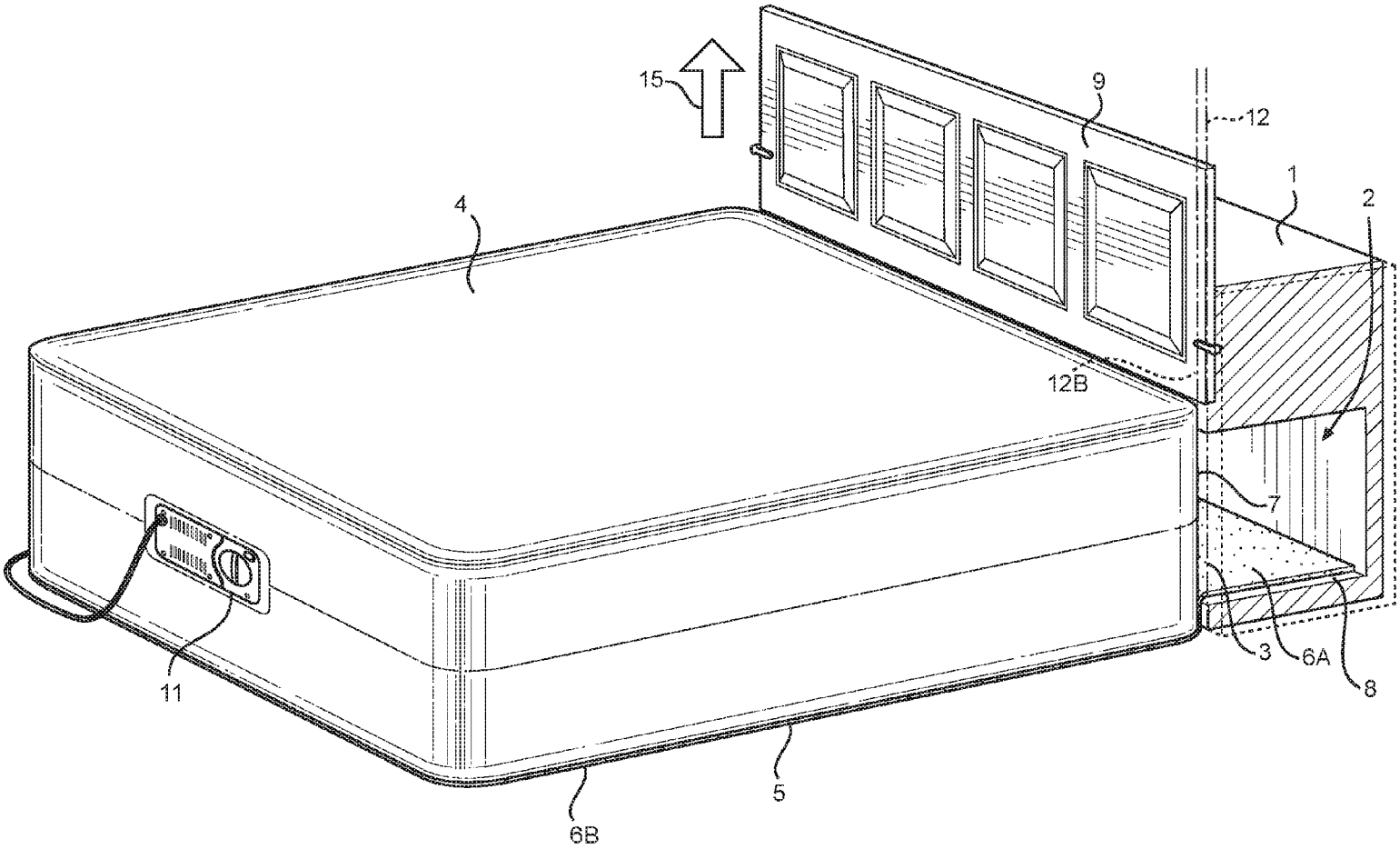
FIG. 4A is a perspective cut-away view of the novel convertible stand having the barrier oriented in an upper position when the inflatable mattress is inflated.
Figure 4B:
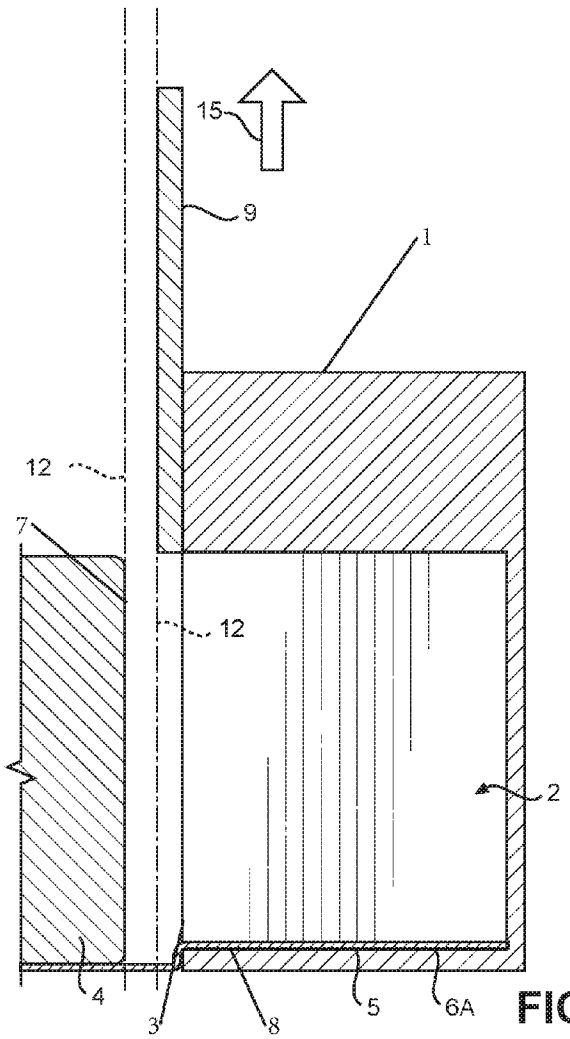
FIG. 4B is a side cut-away view of the novel convertible stand having at least a portion of the inflatable mattress being positioned substantially parallel to the barrier when the inflatable mattress is inflated; and, FIG. 5 is a side cut-away view of an alternate embodiment of the novel convertible stand having an inflatable mattress with a protruding portion in communication with an inner wall surface of the compartment.

FIGS. 2, 3, 4A, and 4B illustrate convertible stand 1 having barrier 9 oriented in upper position 15. Convertible stand 1 has compartment 2 with compartment opening 3. FIGS. 2 and 3 best depict barrier 9 being secured to convertible stand 1 in upper position 15 with fasteners 10A and 10B. FIGS. 2 and 3 best depict compartment 2 retaining pliable material 5 and deflated inflatable mattress 4. FIGS. 3, 4A and 4B best show pliable material 5 having primary end 6A that protrudes from end 7 of inflatable mattress 4. Primary end 6A of pliable material 5 is connected to inner wall surface 8 of compartment 2.

FIGS. 4A and 4B show end 7 of inflated mattress 4 being substantially parallel 12 to barrier 9. Primary end 6A of pliable material 5 has a length great enough to position end 7 of mattress 4 substantially parallel 12 to barrier 9 when primary end 6A of pliable material 5 is connected to inner wall surface 8 of compartment 2. FIG. 4A shows pliable material 5 having primary end 6A located opposite secondary end 6B. Inflatable mattress can have air pump 11 (FIG. 4A).

Figure 5:
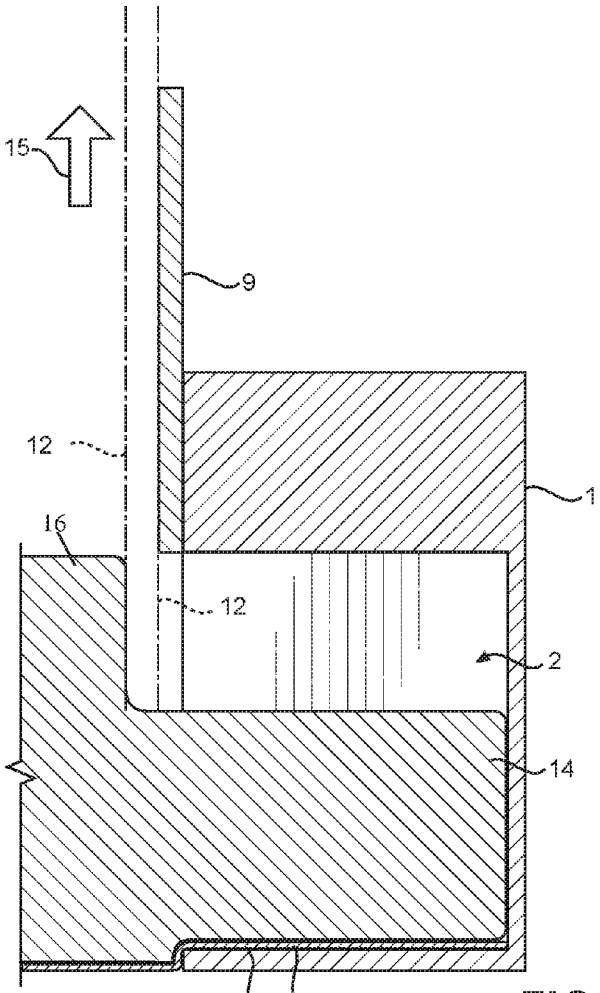

FIG. 5 illustrates an alternate embodiment of convertible stand 1 having inflatable mattress 16 with protruding portion 14 located within compartment 2. Protruding portion 14 of inflatable mattress 16 has a height that is shorter in size than the height of inflatable mattress 16 portion positioned outside of compartment 2. Protruding portion 14 of inflatable mattress 16 is in communication with inner wall surface 8 of compartment 2. FIG. 5 shows protruding portion 14 of inflatable mattress 16 being connected to pliable material 5. Pliable material 5 is connected to inner wall surface 8 of compartment 2. It is within the scope of this invention for protruding portion 14 of inflatable mattress 16 to be connected directly to inner wall surface 8 of compartment 2. A portion of inflatable mattress 16 is substantially parallel 12 to barrier 9 when inflated. Barrier 9 is converted into a headboard when barrier 9 is positioned higher than inflatable mattress 16 when oriented in upper position 15.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A convertible stand, comprising:

said convertible stand having a compartment, whereby, said compartment having a compartment opening;

an inflatable mattress, said inflatable mattress is connected to at least a portion of a pliable material, whereby, said inflatable mattress overlays said pliable material, said pliable material is a skid resistant material, said pliable material having a first end located opposite a second end whereby, said first end of said pliable material extends beyond an end of said inflatable mattress, a portion of said first end of said pliable material is connected to an inner wall surface of said compartment, thereby, connecting said inflatable mattress to said convertible stand;

a barrier, said barrier is connected to said convertible stand, said barrier is configured to be oriented in an upper position and a lower position, whereby, said barrier converts into a headboard when said barrier is oriented in said upper position and when said inflatable mattress is inflated;

a portion of said inflatable mattress is exposed when said barrier is oriented in said upper position, whereby, a portion of said barrier is positioned at a height that is higher than said inflatable mattress when said inflatable mattress is inflated, at least a portion of said inflatable mattress is positioned substantially parallel to said barrier when said inflatable mattress is inflated; and said inflatable mattress and said pliable material are both retained within said compartment of said convertible stand when said barrier is oriented in said lower position, whereby, said barrier covers at least a portion of said compartment opening of said convertible stand.

2. The convertible stand of claim 1, further comprising said barrier having at least one fastener connected thereto, said at least one fastener is configured to retain said barrier in said upper position.

3. The convertible stand of claim 1, further comprising at least a portion of said inflatable mattress is in communication with an inner wall surface of said compartment when said inflatable mattress is inflated.

4. The convertible stand of claim 1, further comprising said inflatable mattress having an air pump connected thereto.

* * * * *